US005721577A

United States Patent [19]

Ostermeier et al.

[11] Patent Number: 5,721,577

[45] Date of Patent: Feb. 24, 1998

[54] LARGE CAPACITY INK CARTRIDGE

[75] Inventors: Bruce H. Ostermeier, Irvine; Allan S. Miller, Fullerton, both of Calif.

[73] Assignee: CalComp Inc., Anaheim, Calif.

[21] Appl. No.: 434,218

[22] Filed: May 4, 1995

[51] Int. Cl.[6] ..... B41J 2/305

[52] U.S. Cl. ..... 347/86

[58] Field of Search ..... 347/85, 86, 87

[56] References Cited

U.S. PATENT DOCUMENTS

| | | | |
|---|---|---|---|
| 4,025,928 | 5/1977 | Hou et al. | 347/87 |
| 5,010,354 | 4/1991 | Cowger et al. | 347/87 |
| 5,425,478 | 6/1995 | Kotaki et al. | 222/501 |

*Primary Examiner*—Benjamin R. Fuller
*Assistant Examiner*—Craig A. Hallacher
*Attorney, Agent, or Firm*—Frederic P. Smith; William F. Porter, Jr.

[57] ABSTRACT

An improved ink cartridge comprising an ink chamber, a pressure relief chamber coupled to the ink chamber, and at least one air bleed hole coupling the pressure relief chamber to the ink chamber, the air bleed hole having a capillary dimension for creating a negative pressure on any ink in the air chamber. The pressure relief chamber is positioned below the ink chamber, the ink chamber including an opening to couple the ink cartridge to an ink head, the opening including an automatic shutoff valve, and the air bleed hole is positioned at the bottom of the ink chamber.

12 Claims, 1 Drawing Sheet

LARGE CAPACITY INK CARTRIDGE

BACKGROUND OF THE INVENTION

1. Field of the Invention

This invention relates to the field of ink cartridges for plotters and, in particular, to an improved large capacity ink cartridge for an ink jet printer.

2. Description of Related Art

With the increased use of computer hardware and software to generate information in visible multidimensional form such as graphs and graphics, there has come a concomitant increase in the use of plotters to fix such information on a tangible media. Plotters capable of handling the output of such computer systems have been developed and are continually being upgraded to ensure that fast and accurate plots will be produced. Problems have arisen with ink jet type printers in which the ink jet head, or inker, applies ink to a media surface. In order to increase the time between replacement of ink supplies, larger ink jet cartridges are being used. However, the increased volume of ink held by these cartridges has caused problems in controlling the evenness of flow of ink to the head. Such increased volume of ink has also caused leakage of ink from both the cartridge and the head itself due to variations in temperature and atmospheric pressure. In order to solve these problems, numerous cartridges use a controlled porosity polyurethane foam in various parts of the cartridge to control both the flow to and leaking of ink from the head and the leaking of ink from the cartridge. Since the porosity of the foam and the extended surface area of the foam presented to the ink chamber are difficult to control, these devices can handle only a limited volume of ink.

Thus, it is a primary object of the present invention to provide an improved large capacity cartridge for an ink jet printer.

It is another object of the present invention to provide an improved large capacity cartridge for an ink jet printer that provides an even flow of ink to the ink head over the entire range of demand.

It is a further object of the present invention to provide an improved large capacity cartridge for an ink jet printer that prevents leakage of ink from the ink head.

It is still another object of the present invention to provide an improved large capacity cartridge for an ink jet printer that prevents leakage of ink from the cartridge upon installation or removal.

It is a further object of the present invention to provide an improved large capacity cartridge for an ink jet printer that accommodates temperature changes, pressure changes from transport height variations, and liquid surges and vibrations.

It is a further object of the present invention to provide an improved large capacity cartridge for an ink jet printer that provides independent control of pressure and ink flow rate to the ink head.

SUMMARY OF THE INVENTION

An improved ink cartridge comprising an ink chamber, a pressure relief chamber coupled to the ink chamber, and at least one air bleed hole coupling the pressure relief chamber to the ink chamber, the air bleed hole having a capillary dimension for creating a negative pressure on any ink in the ink chamber. The pressure relief chamber is positioned below the ink chamber, the ink chamber including an opening to couple the ink cartridge to an ink head, the opening including an automatic shutoff valve, and the air bleed hole is positioned at the bottom of the ink chamber.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

DESCRIPTION OF THE PREFERRED EMBODIMENT

Figure 1:
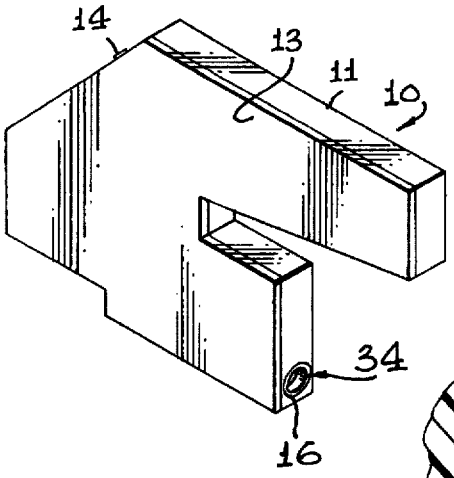
FIG. 1 is a perspective front view of the structure of the present invention.
Figure 2:
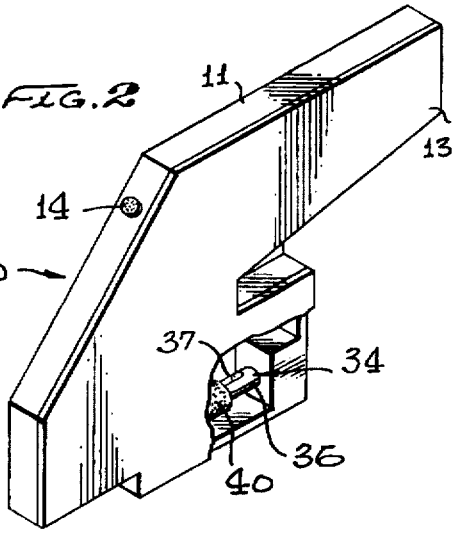
FIG. 2 is a perspective rear view, partially broken away, of the structure of the present invention.
Figure 6:
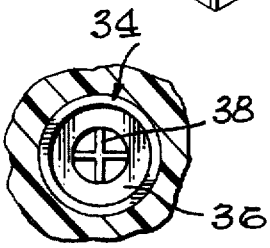
FIG. 6 is a cross-sectional view taken along line 6—6 of FIG. 3.
Figure 7:
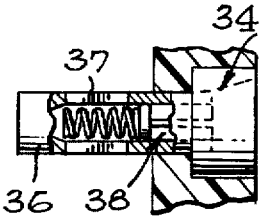
FIG. 7 is a side-view, partially broken away, of the valve mechanism used in the present invention.
Figure 3:
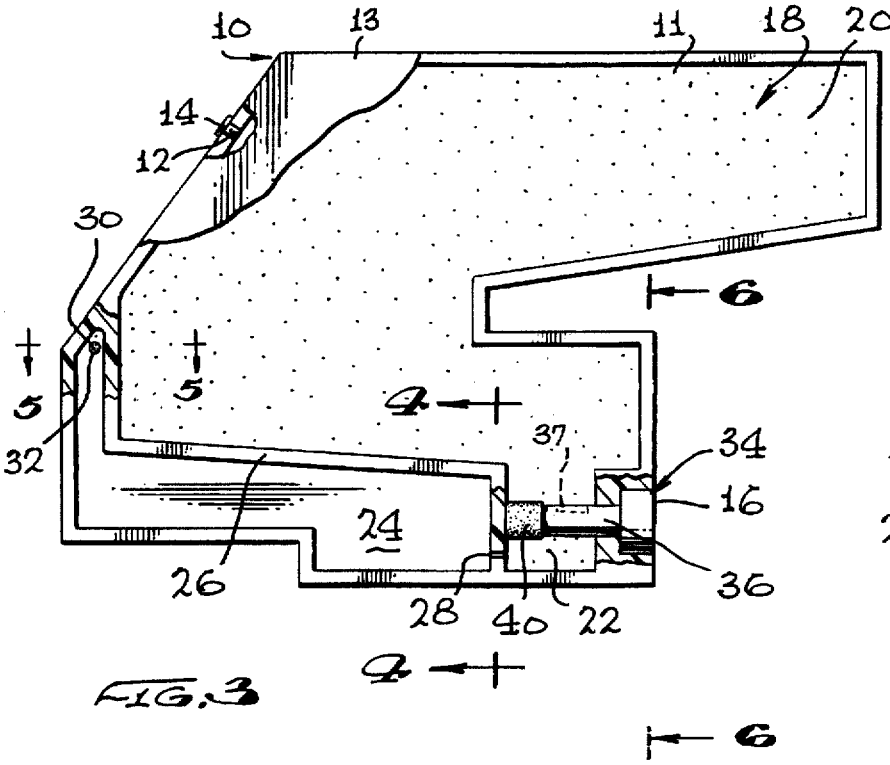
FIG. 3 is a side view, partly broken away, of the structure of the present invention.
Figure 5:
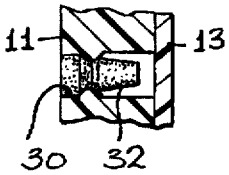
FIG. 5 is an enlarged cross-sectional view taken along line 5—5 of FIG. 3.
Figure 4:
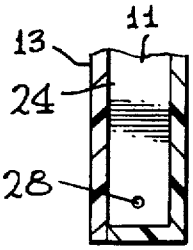
FIG. 4 is a cross-sectional view of FIG. 3 taken along line 4—4 of FIG. 3.

Referring now to FIGS. 1–3, a cartridge 10 is shown having a housing 11 and a housing cover 13. The cartridge 10 has a fill hole 12 and a fill plug 14 and an opening 16 for connection to tubing leading to an ink head, not shown. The cartridge 10 has an ink chamber 18 having an upper portion 20 and a lower portion 22 adjacent to the opening 16 for providing ink to the ink head. Below the upper portion 20 and adjacent to the lower portion 22 is a pressure relief chamber 24 separated by wall 26 from the ink chamber 18 and coupled to the lower portion 22 and the opening 16 by at least one air bleed hole or aperture 28, shown also in FIG. 4. As explained more fully hereinafter, the air bleed hole 28 has a capillary dimension to create a negative air pressure on the ink in the lower portion 22 of the ink chamber 18. The pressure relief chamber 24 has a vent hole 30 extending through the housing 11 to the outside atmosphere and a porous plug 32 positioned inside and extending through the vent hole 30 into the interior of the chamber 24, as shown in FIG. 5. The opening 16 has positioned therein, as shown in FIGS. 3 and 6–7, an automatic shutoff valve 34 which has an outer body or housing 36 and an inner body 38 which is spring-loaded so that in a disconnected mode the inner body 38 seals the valve 34 and prevents ink from leaking out and in a connected mode is forced inwardly by the tube from the ink head to open the valve 34 and allow ink to flow through the outer body 36 to the ink head. The housing 36 has a plurality of slots 37 therein which go through opposite sides of the housing 36 and are vertically oriented so that on filling an empty cartridge 10 with ink air is not trapped within the valve 34 which could cause difficulties in the initiation of the ink flow without excessive vacuum in the purge cycle. The opening 16 also includes a wicking plug 40 which is positioned between the valve 34 and the wall 26 and which functions as a surge suppressor without restricting flow. The porous plug 32 acts in conjunction with the valve 34 to keep ink from leaking out the vent hole 30 when the cartridge 10 is oriented in any direction unless the porous plug 32 becomes covered with ink and a temperature increase inside the cartridge forces ink through the porous plug 32. The porous plug 32 is made from a hydrophobic material, such as porous teflon, and has a surface free energy less than the surface tension of the ink.

Initially, the ink chamber 18 of the cartridge 10 is filled to capacity with all air excluded, the fill plug 14 is inserted and sealed and the vent hole 30 is covered with sealing tape (not shown), the pressure relief chamber 24 remaining filled with air. Automatic shutoff valve 34 acts to prevent ink leakage when the cartridge 10 is not installed in the ink jet printer and also during installation or removal of the cartridge 10 from the ink head. Furthermore, the valve 34 functions to contain the ink in the ink cartridge 10 during thermal cycles, as discussed hereinafter. When the cartridge 10 is about to be connected to the ink head, the sealing tape is removed. The ink is held in the ink chamber 18 by the atmospheric pressure exerted on the air bleed hole 28 through the pressure relief chamber 24 from the open vent hole 30. No movement of the ink occurs until the cartridge 10 is connected to the ink head and air enters the air bleed hole 28 to replace the ink removed. When the cartridge 10 is connected by a tube from the ink head being inserted into opening 16, the valve 34 is opened. There is still little or no ink flow from the cartridge 10 due to the capillary dimensions of both the air bleed hole 28 and the ink head nozzles until the ink head is purged, generally by an applied vacuum of sufficient magnitude to exceed the capillary action of both the nozzles and the air bleed hole 28. As the vacuum is applied to the ink head, ink is pulled from the cartridge 10 and, simultaneously, air is pulled in through the vent hole 30 into the pressure relief chamber 24 and through the capillary air bleed hole 28 to displace the ink removed. It is assumed that the cartridge 10 is connected directly to the ink head, that the ink head nozzles are located somewhat below the connection to the cartridge 10, generally one inch or less, and that once connected there is no pathway for air to be drawn into the ink head, i.e. there is an air tight connection. Additionally, the diameters of the ink head nozzles are on the order of one to two thousandths of an inch and operate at a slightly negative pressure, with the ink meniscus at the nozzles being slightly concave, all of which causes a capillary action to act to control the ink at the ink head and stop the ink from leaking.

As is apparent then, the capillary diameter of the air bleed hole 28, generally of the order of 30 thousandths of an inch, maintains a partial vacuum on the ink chamber 18 due to such capillary dimensions and, more particularly, maintains a partial vacuum on the ink in the lower portion 22 of the ink chamber 18 due to its being positioned at the bottom of the ink chamber 18. This is in contrast to prior art devices in which the pressure exerted by the ink on the ink head was atmospheric pressure plus the hydraulic head due to the height difference between the nozzles and a non-capillary dimension air bleed hole between an ink chamber and an air pressure relief chamber. Furthermore, the provision of such a capillary air bleed hole 28 provides a backup to the capillary action of the ink head nozzles to stop leakage at the ink head by providing a partial vacuum on the ink head nozzles and also assures that ink is not pulled too rapidly from the cartridge 10 during purging. In addition, ink is always delivered to the ink head at a constant pressure and flow for the life of the cartridge 10 due to the provision of the air bleed hole 28 of constant capillary diameter, since the pressure at the ink head nozzles is established and maintained by (1) the balance of air and vapor in the ink chamber 18, (2) the liquid level of ink in the ink chamber 18, (3) the capillary force of the air bleed hole 28 and (4) the atmospheric pressure exerted on the liquid interface in the air bleed hole 28, and air is automatically drawn in through the air bleed hole 28 to maintain this pressure balance. Since ink pressure and flow are controlled by air flowing through the air bleed hole 28, the magnitude of the pressure is controlled by the diameter of the air bleed hole 28 and can be varied by changing such diameter and the magnitude of the flow is controlled by the area of the air bleed hole 28 and can be varied independently of pressure by having a plurality of air bleed holes 28 of fixed diameter whose summed area equals the hole area necessary to generate the desired magnitude of flow.

As stated above, the cartridge 10 has the pressure relief chamber 24 located below the upper portion 20 of the ink chamber 18. This enables the cartridge 10 to accommodate large temperature changes when connected to the ink head without leaking. On heating, any air in the ink chamber 18 expands and the water vapor pressure from the ink increases exerting pressure on the ink in the ink chamber 18. Since the valve 34 is open, valve 34 cannot isolate ink from the ink head. Because the nozzles in the ink head are smaller in diameter than the air bleed hole 28, capillary action will favor ink flow through the air bleed hole 28 and the pressure buildup is relieved by ink flowing into the pressure relief chamber 24. When the temperature returns to its original state, ink will be drawn into the ink chamber 18 from the pressure relief chamber 24 by the contraction of air and reduction of vapor pressure and because the location of the air bleed hole 28 maintains contact with any ink in the pressure relief chamber 24. The positioning of the pressure relief chamber 24 at the bottom of the cartridge 10 below the ink chamber 18 minimizes the transfer of hydraulic pressure to the ink head nozzles when ink fills the pressure relief chamber 24 due to pressure buildup. Additionally, the pressure relief chamber 24 also relieves pressure buildup when a disconnected cartridge 10 is subject to temperature changes. The chamber 24 is made large enough for the cartridge 10 to accommodate liquid transfer resulting from temperature changes of up to 40° Celsius. The ink chamber 18 is generally made to hold at least 30 ml of ink instead of the typical 9 ml and the pressure relief chamber 24 is generally made to hold 6 ml of ink. The size of the pressure relief chamber 24 is based on the volume of ink, air and vapor in the cartridge 10 and the range of temperature change. When the cartridge 10 is inverted, excess air and vapor will exit through the pressure relief chamber 24 now at the top of the cartridge 10. When the cartridge 10 is returned to the upright position, the partial vacuum in the ink chamber 18 above the ink is reestablished. The ink level in the ink chamber 18 will drop slightly and some ink may move from the ink chamber 18 to the pressure relief chamber 24 to balance the system.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

We claim:

1. An improved ink cartridge for providing a flow of ink to an ink head and for regulating a magnitude of pressure and a magnitude of flow of said ink comprising:

an ink chamber for containing said ink;

a pressure relief chamber coupled to said ink chamber by one or more apertures provided between said pressure relief chamber and said ink chamber, at least one aperture of said one or more apertures having a capillary dimension that creates a negative pressure on said ink in said ink chamber, said pressure relief chamber and said at least one aperture of said one or more apertures providing pressure relief to said ink in said ink chamber, providing a partial vacuum on said ink in said ink chamber and regulating said magnitude of pressure of said ink and said magnitude of flow of said ink; and coupling means for coupling said ink cartridge to said ink head.

2. The cartridge of claim 1 wherein said negative pressure has a magnitude and said aperture has a selected capillary dimension for controlling said magnitude of said negative pressure.

3. The cartridge of claim 1 wherein said one or more apertures comprises a plurality of apertures, said plurality of apertures having a selected number, and said flow of ink flows from said ink chamber to said ink head coupled to said cartridge, said flow of ink having a selected magnitude, said selected magnitude of said flow of ink being controlled by said selected number of apertures.

4. The cartridge of claim 1 wherein said cartridge is coupled to an ink head having ink jet nozzles therein with a selected capillary dimension, said aperture having a capillary dimension which is an order of magnitude larger than said selected capillary dimension.

5. The cartridge of claim 1 wherein said pressure relief chamber is positioned below said ink chamber.

6. The cartridge of claim 1 wherein said ink chamber has a bottom and includes said coupling means for coupling said ink cartridge to said ink head, said coupling means being positioned near said bottom of said ink chamber.

7. The cartridge of claim 6 wherein said aperture is positioned near said bottom of said ink chamber.

8. The cartridge of claim 1 wherein said ink chamber includes coupling means to couple said ink cartridge to an ink head, said coupling means including a surge suppressor.

9. The cartridge of claim 1 wherein said aperture has a selected capillary dimension and said ink flows from said ink chamber to said ink head coupled to said cartridge, said flow having a selected magnitude of pressure, said selected magnitude of pressure being controlled by said capillary dimension of said aperture.

10. An improved ink cartridge for providing a flow of ink to an ink head and for regulating a magnitude of pressure and a magnitude of flow of said ink comprising:

an ink chamber containing said ink;

a pressure relief chamber coupled to said ink chamber by one or more apertures provided between said pressure relief chamber and said ink chamber, at least one aperture of said one or more apertures having a capillary dimension that creates a negative pressure on said ink in said ink chamber, said pressure relief chamber and said at least one aperture of said one or more apertures providing pressure relief to said ink in said ink chamber, providing a partial vacuum on said ink said ink chamber and regulating said magnitude of pressure of said ink and said magnitude of flow of said ink; and coupling means for coupling said ink cartridge to said ink head, said coupling means including an automatic shutoff valve, said automatic shutoff valve having a housing, and said housing having one or more slots therein for allowing air to exit said housing.

11. The cartridge of claim 10 wherein said slots are vertically oriented for allowing air to exit said cartridge housing.

12. An improved ink cartridge for providing a flow of ink to an ink head and for regulating a magnitude of pressure and a magnitude of flow of said ink comprising:

an ink chamber containing said ink;

a pressure relief chamber coupled to said ink chamber by one or more apertures provided between said pressure relief chamber and said ink chamber, at least one aperture of said one or more apertures having a capillary dimension that creates a negative pressure on said ink in said ink chamber, said pressure relief chamber and said at least one aperture of said one or more apertures providing pressure relief to said ink in said ink chamber, providing a partial vacuum on said ink said ink chamber and regulating said magnitude of pressure of said ink and said magnitude of flow of said ink; and coupling means for coupling said ink cartridge to said ink head, said coupling means including a surge suppressor.

* * * * *

UNITED STATES PATENT AND TRADEMARK OFFICE

CERTIFICATE OF CORRECTION

PATENT NO. : 5,721,577

DATED : February 24, 1998

INVENTOR(S) : Bruce H. Ostermeier et al

It is certified that error appears in the above-identified patent and that said Letters Patent is hereby corrected as shown below:

On the title page, item [75] Inventors: add the following inventors

Stephen R. Boss
836 Huron Drive
Claremont, California 92711

Hoan V. Nguyen
2676 North River Trail
Orange, California 92665

Signed and Sealed this

Second Day of March, 1999

*Attest:*

Q. TODD DICKINSON

*Attesting Officer*

*Acting Commissioner of Patents and Trademarks*